US011118304B2

(12) United States Patent
Hato et al.

(10) Patent No.: US 11,118,304 B2
(45) Date of Patent: Sep. 14, 2021

(54) CLOTHES DRYER

(71) Applicant: Samsung Electronics Co., Ltd., Suwon-si (KR)

(72) Inventors: Shigenori Hato, Yokohama (JP); Toshifumi Hashimoto, Yokohama (JP); Yuji Aoshima, Yokohama (JP); Hitoshi Minai, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/481,051

(22) PCT Filed: Jan. 22, 2018

(86) PCT No.: PCT/KR2018/000941
§ 371 (c)(1),
(2) Date: Jul. 25, 2019

(87) PCT Pub. No.: WO2018/139818
PCT Pub. Date: Aug. 2, 2018

(65) Prior Publication Data

US 2019/0345662 A1 Nov. 14, 2019

(30) Foreign Application Priority Data

Jan. 25, 2017 (JP) ..... JP2017-011646
Feb. 23, 2017 (JP) ..... JP2017-032193
Dec. 6, 2017 (JP) ..... JP2017-233966

(51) Int. Cl.
*D06F 58/22* (2006.01)

(52) U.S. Cl.
CPC ..... *D06F 58/22* (2013.01)

(58) Field of Classification Search
CPC ..... D06F 58/22; D06F 58/20; D06F 58/30; D06F 58/26; D06F 33/32; F26B 19/00
USPC ..... 34/82, 595–610
See application file for complete search history.

(56) References Cited

U.S. PATENT DOCUMENTS 3,639,998 A * 2/1972 Mason ..... D06F 58/22 34/82
3,653,807 A * 4/1972 Platt ..... D06F 39/10 8/158
4,314,409 A * 2/1982 Cartier ..... D06F 58/22 34/604

(Continued)

FOREIGN PATENT DOCUMENTS

DE 102005054684 A1 * 5/2007 ..... D06F 58/22
EP 1788142 A2 * 5/2007 ..... D06F 58/22

(Continued)

OTHER PUBLICATIONS

ISA/KR, "International Search Report and Written Opinion of the International Searching Authority," International Application No. PCT/KR2018/000941, dated May 23, 2018, 11 pages.

*Primary Examiner* — Stephen M Gravini

(57) ABSTRACT

A clothes dryer comprises a drum to stir clothes accommodated therein, an exhaust duct configured to discharge air inside the drum, a lint removing device including a filter to remove lint in air discharged to the exhaust duct, and a foreign-substance separating plate installed between the exhaust duct and the lint removing device to separate solid foreign substances in the air discharged to the exhaust duct.

20 Claims, 18 Drawing Sheets

(56) References Cited

U.S. PATENT DOCUMENTS

| | | | | | |
|---|---|---|---|---|---|
| 4,653,200 | A * | 3/1987 | Werner | D06F 58/22 | 34/604 |
| 5,062,219 | A * | 11/1991 | Harris | D06F 58/02 | 34/606 |
| 5,701,684 | A * | 12/1997 | Johnson | D06F 58/22 | 34/595 |
| 5,940,986 | A * | 8/1999 | Jelinek | D06F 58/04 | 34/528 |
| 6,076,378 | A * | 6/2000 | Shin | D06F 39/10 | 68/18 F |
| 7,305,775 | B2 * | 12/2007 | Favret | D06F 58/22 | 34/82 |
| 7,805,856 | B2 * | 10/2010 | Gaßmann | D06F 58/22 | 34/85 |
| 7,913,415 | B2 * | 3/2011 | Goldberg | D06F 58/22 | 34/82 |
| 7,930,838 | B2 * | 4/2011 | Bae | D06F 58/02 | 34/597 |
| 8,615,895 | B2 * | 12/2013 | Shin | D06F 58/22 | 34/82 |
| 8,667,705 | B2 * | 3/2014 | Shin | D06F 58/22 | 34/82 |
| 8,997,377 | B2 * | 4/2015 | Kim | D06F 58/30 | 34/610 |
| 9,567,704 | B2 * | 2/2017 | Ros | D06F 58/22 | |
| 9,885,145 | B2 * | 2/2018 | Bae | D06F 58/04 | |
| 10,077,528 | B2 * | 9/2018 | Yoichi | D06F 58/22 | |
| 10,280,552 | B2 * | 5/2019 | Kulkarni | D06F 58/22 | |
| 10,604,885 | B2 * | 3/2020 | Lv | B01D 46/48 | |
| 10,619,289 | B2 * | 4/2020 | Bocchino | D06F 58/22 | |
| 10,765,974 | B2 * | 9/2020 | Renz | B01D 46/00 | |
| 2007/0107250 | A1 * | 5/2007 | Gassmann | D06F 58/22 | 34/82 |
| 2011/0271543 | A1 | 11/2011 | Kim et al. | | |
| 2017/0037560 | A1 | 2/2017 | Shin et al. | | |

FOREIGN PATENT DOCUMENTS

| | | | | |
|---|---|---|---|---|
| GB | 2430863 | A * | 4/2007 | A47L 9/1691 |
| JP | 2016107025 | A | 6/2016 | |
| JP | 2018134385 | A * | 8/2018 | D06F 58/22 |
| KR | 10-2008-0013250 | A | 2/2008 | |
| KR | 10-1191208 | B1 | 10/2012 | |
| KR | 10-1425904 | B1 | 8/2014 | |
| KR | 10-2015-0120054 | A | 10/2015 | |

* cited by examiner

CLOTHES DRYER

CROSS-REFERENCE TO RELATED APPLICATIONS

This application is a 371 National Stage of International Application No. PCT/KR2018/000941, filed Jan. 22, 2018, which claims priority to Japanese Patent Application No. 2017-011646, filed Jan. 25, 2017, Japanese Patent Application No. 2017-032193, filed Feb. 23, 2017, and Japanese Patent Application No. 2017-233966, filed Dec. 6, 2017, the disclosures of which are herein incorporated by reference in their entirety.

BACKGROUND

1. Field

The present disclosure relates to a clothes dryer for accommodating and drying clothes in a rotating drum.

2. Description of Related Art

A conventional clothes dryer circulates drying air such as hot air in a drum accommodating clothes to dry the clothes. The air discharged from the drum is introduced into a heat exchanger through an exhaust duct. Normally, on an upstream side of the heat exchanger, there is provided a filter for collecting lint (fluff) mixed in the drying air.

Patent Document 1: Japanese Unexamined Patent Publication 2016-107025

Patent Document 2: Japanese Unexamined Patent Publication 2013-123444

SUMMARY

The drying air may contain not only lint, but also solid foreign substances such as buttons and hooks that fall from clothes, and there is a problem that the foreign substances enter the filter and damages the filter.

Patent Document 1 discloses a configuration in which a plurality of fins including slits is provided in an exhaust duct and each of the fins is inclined to a drum side to return foreign substances into the drum.

However, the exhaust duct needs a certain opening area in order to maintain the drying performance of clothes. Therefore, foreign substances smaller than the opening area of the exhaust duct may enter the filter.

Patent Document 2 discloses a configuration in which a clothes dryer includes a lint collecting device which rotates while being in contact with the inner surface of a filter portion, and the lint collecting device has a spiral portion intersecting at a predetermined angle with respect to the flow direction of drying air and is elastically supported to the filter portion side by receiving the drying air through the spiral portion.

However, there is a problem that it is difficult to secure a sufficient volume of a lint storage portion because the lint separated from the filter portion is directly sent to the lint storage portion.

One aspect of the present disclosure is directed to providing a clothes dryer capable of solving the above-described conventional problems and preventing foreign substances such as buttons from entering a lint collecting filter, and another aspect of the present disclosure is directed to providing a clothes dryer capable of reducing the volume of a lint storage portion for storing collected lint. However, it is not necessary to simultaneously achieve the above two aspects, and it is sufficient if any one of them may be achieved.

In order to achieve one aspect described above, the present disclosure includes a foreign-substance separating member for separating solid foreign substances between an exhaust port and a lint removing device including a filter. In order to achieve another aspect described above, the present disclosure includes a configuration for compressing and accumulating lint separated and collected from a filter.

Specifically, the present disclosure is applied to a clothes dryer, and the following solutions are provided.

One aspect of the present disclosure provides a clothes dryer including a drum to stir clothes accommodated therein, an exhaust duct configured to discharge air inside the drum, a lint removing device including a filter to remove lint in air discharged to the exhaust duct, and a foreign-substance separating plate installed between the exhaust duct and the lint removing device to separate solid foreign substances in the air discharged to the exhaust duct.

The foreign-substance separating plate may include an inclined surface inclined toward the outside of the lint removing device.

The foreign-substance separating plate may include a plurality of the foreign-substance separating plates disposed in a stepped shape with a gap therebetween.

Between two of the foreign-substance separating plates adjacent to each other among the plurality of foreign-substance separating plates, an upper end portion of the lower foreign-substance separating plate may be positioned further rearward than a lower end portion of the upper foreign-substance separating plate.

The exhaust duct may include a side inflow opening formed in a side portion thereof, and the uppermost end portion of the inclined surface of the foreign-substance separating plate may be positioned further rearward than a front end portion of the side inflow opening.

The clothes dryer may further include a foreign-substance accommodating portion disposed below the foreign-substance separating plate and outside the lint removing device, wherein the inclined surface of the foreign-substance separating plate may be inclined toward the foreign-substance accommodating portion.

The plurality of foreign-substance separating plates may include a rib to connect two of the foreign-substance separating plates adjacent to each other.

The plurality of foreign-substance separating plates may include a protrusion protruding from a lower surface of the upper foreign-substance separating plate toward an upper surface of the lower foreign-substance separating plate of two of the foreign-substance separating plates adjacent to each other, and a gap may be formed between the protrusion of the upper foreign-substance separating plate and the lower foreign-substance separating plate.

The lower foreign-substance separating plate may include a notch formed on a region facing the protrusion.

A wind path to flow air may be formed between the foreign-substance separating plate and a partition in the rear of the foreign-substance separating plate.

The clothes dryer may further include an arc-shaped rib protruding in an awning shape from the partition below the exhaust duct and above the lint removing device.

The clothes dryer may further include an air inlet port formed in the rear of the lint removing device and connected to an air supply port inflowing air into the drum, and a plurality of foreign-substance removing plates arranged in parallel between the exhaust duct and the foreign-substance separating plate such that extending directions thereof are directed to a vertical direction or the air inlet port.

The filter may extend in a direction intersecting a rotation shaft of the drum and have an arc-shaped cross section in a direction perpendicular to a longitudinal direction thereof, and the lint removing device may include a lint conveying member provided inside the filter and including a rotation shaft parallel to the longitudinal direction of the filter.

The lint conveying member may include a spiral wing in contact with the inner surface of the filter.

The clothes dryer may further include a lint box to accumulate lint separated and conveyed from the inner surface of the filter by the rotation of the wing of the lint conveying member, and a conical lint compression portion disposed between the filter and the lint box and decreasing in diameter toward the lint box.

An end of the lint conveying member in the lint box side may be inserted into the lint compression portion, and the wing of the lint conveying member may be formed such that the diameter thereof decreases with the decrease in the diameter of the lint compression portion and a peripheral edge thereof is spaced apart from the inner surface of the lint compression portion.

An end of the lint conveying member in the lint box side may be inserted into the lint compression portion, and the wing of the lint conveying member may be formed such that a peripheral edge thereof contacts with the inner surface of the lint compression portion.

The lint compression portion may include at least one protrusion extending to the lint box side on the inner surface thereof.

The protrusion may be formed in a direction perpendicular to an angle of the wing of the lint conveying member.

Another aspect of the present disclosure provides a clothes dryer including a drum to stir clothes accommodated therein, an exhaust duct configured to discharge air inside the drum, and a lint removing device including a filter to remove lint in air discharged to the exhaust duct, wherein the lint removing device includes a filter extending in a direction intersecting a rotation shaft of the drum and having an arc-shaped cross section in a direction perpendicular to a longitudinal direction thereof, a lint conveying member provided inside the filter, and including a rotation shaft parallel to the longitudinal direction of the filter and a spiral wing formed such that a peripheral edge thereof is in contact with the inner surface of the filter, a lint box to accumulate lint separated and conveyed from the inner surface of the filter by the rotation of the wing of the lint conveying member, and a lint compression portion disposed between the filter and the lint box and decreasing in diameter toward the lint box.

According to the present disclosure, solid foreign substances can be prevented from entering a filter for collecting lint. In addition, the volume of a lint storage portion can be reduced.

DETAILED DESCRIPTION

Hereinafter embodiments of the present disclosure will be described in detail with reference to the accompanying drawings. The following description of the preferred embodiments is merely exemplary and is not intended to limit the present disclosure, its application, or uses thereof.

First Embodiment

A first embodiment of the present disclosure will be described below with reference to the accompanying drawings.

Figure 1:
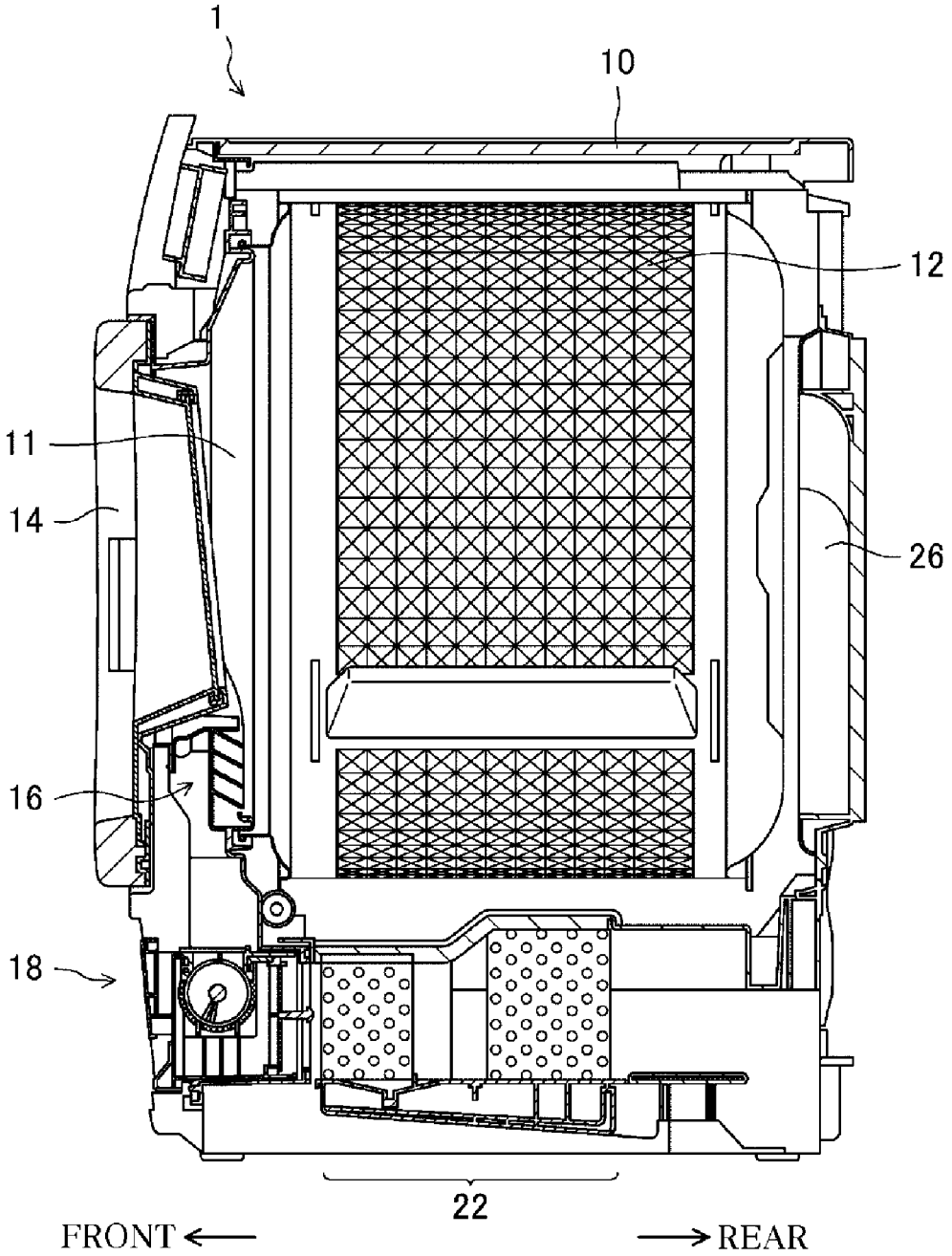
FIG. 1 is a right side cross-sectional view illustrating a clothes dryer according to a first embodiment of the present disclosure.
Figure 2:
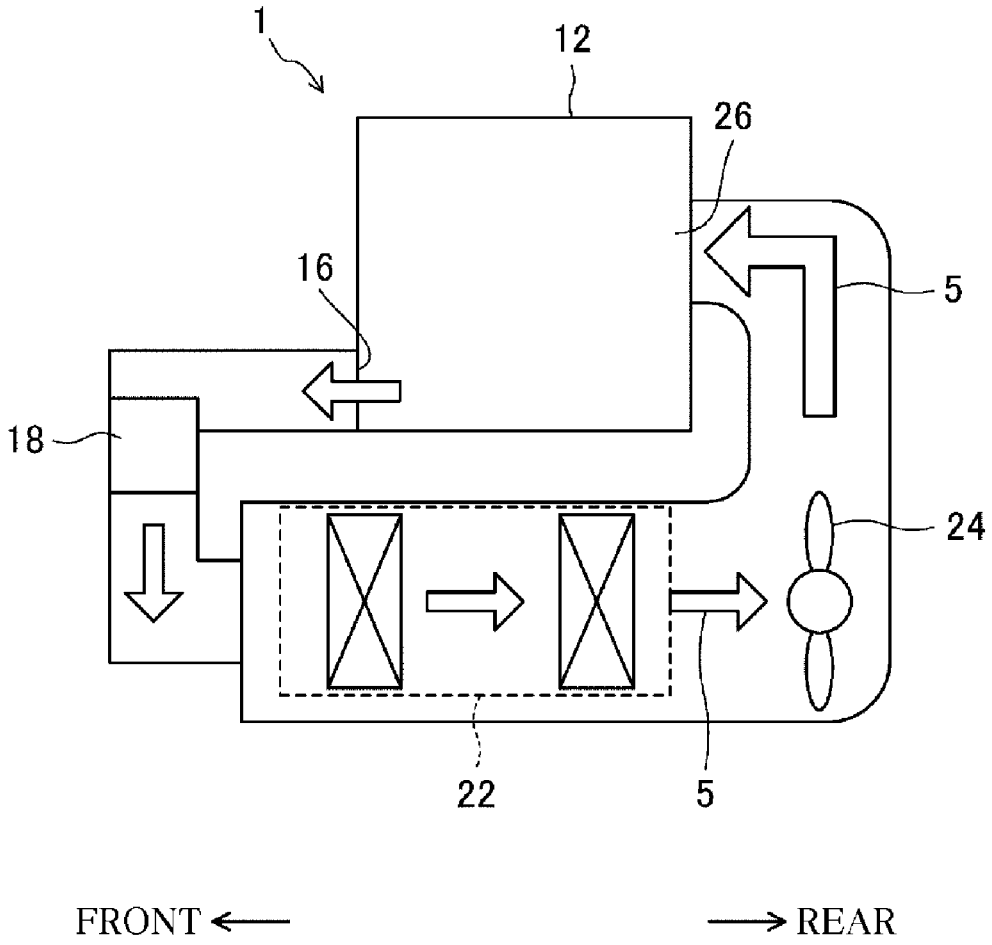
FIG. 2 is a functional block diagram schematically illustrating a circulating air route of the clothes dryer according to the first embodiment of the present disclosure.

FIGS. 1 and 2 illustrate a configuration of a clothes dryer according to the first embodiment. FIG. 1 illustrates a cross-sectional configuration of the right side of the clothes dryer, and FIG. 2 schematically illustrates a circulation route of drying air in the clothes dryer. As illustrated in FIGS. 1 and 2, a clothes dryer 1 according to the present embodiment, which is an air circulation type dryer, generates drying air 5 while circulating air, and dries clothes using the generated drying air 5. The clothes dryer 1 has a case 10 of a substantially rectangular parallelepiped shape and an inlet 11 for inputting or discharging clothes is formed in an upper portion of a front surface of the case 10. A door 14 is attached to the inlet 11 through a hinge (not shown), and the inlet 11 is opened and closed by the door 14.

A drum 12, which is supported by, for example, two rollers (not shown) in a state in which an opening thereof faces the inlet 11, is rotated by a belt (not shown) around a shaft extending in a longitudinal direction, and stirs the input clothes, is disposed inside the case 10.

An exhaust duct (exhaust port) 16 is formed below the inlet 11 of the case 10, and a lint removing device 18 including a filter for collecting lint (fluff) is disposed at a downstream side (that is, a lower side) of the exhaust duct 16. A heat exchanger 22 is disposed below the drum 12 as a downstream side of the lint removing device 18. The air heated by the heat exchanger 22 is transmitted from an air supply port 26 on a rear surface of the drum 12 to the clothes inside the drum 12 by an air blowing fan 24. High humidity air containing moisture released from the clothes is discharged from a front surface of the drum 12 through the exhaust duct 16 and the lint removing device 18 and then dehumidified by being cooled down to a dew point or less by the heat exchanger 22.

FIG. 1 illustrates the clothes dryer 1 as an example of the application of the present disclosure, but the present disclosure is not limited thereto and is also applicable to a washing and drying machine. In addition, although a belt is used for rotating the drum 12, a DD motor system in which a drum rotation shaft is directly rotated by a motor rotation shaft may be used. Further, although the heat exchanger 22 is used to generate and dehumidify drying air, a heater system including a heater provided in the main body of the clothes dryer 1 to generate hot air may be used.

Figure 3:
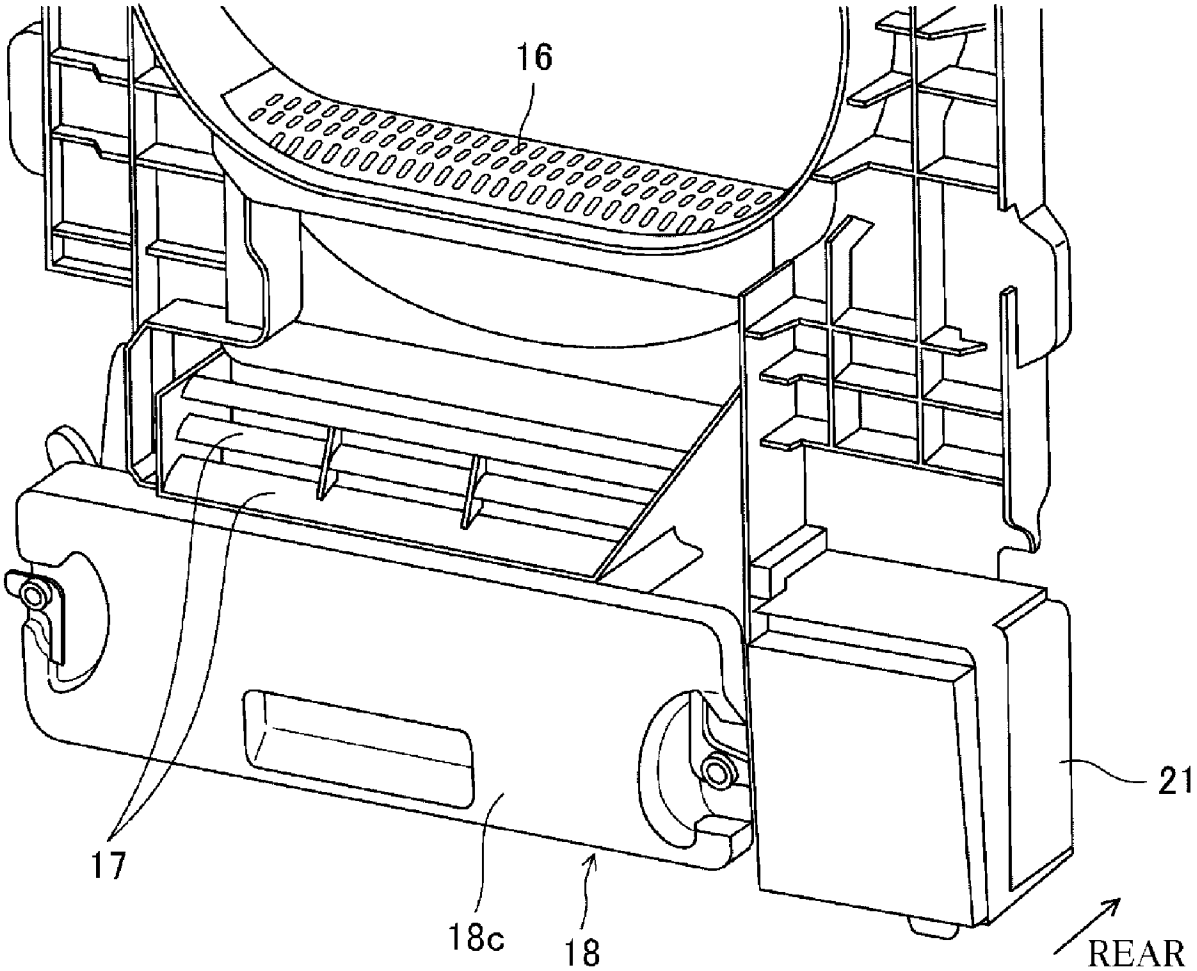
FIG. 3 is a partial perspective view illustrating an exhaust duct, foreign-substance separating plates and a lint removing device constituting the clothes dryer according to the first embodiment of the present disclosure.
Figure 4:
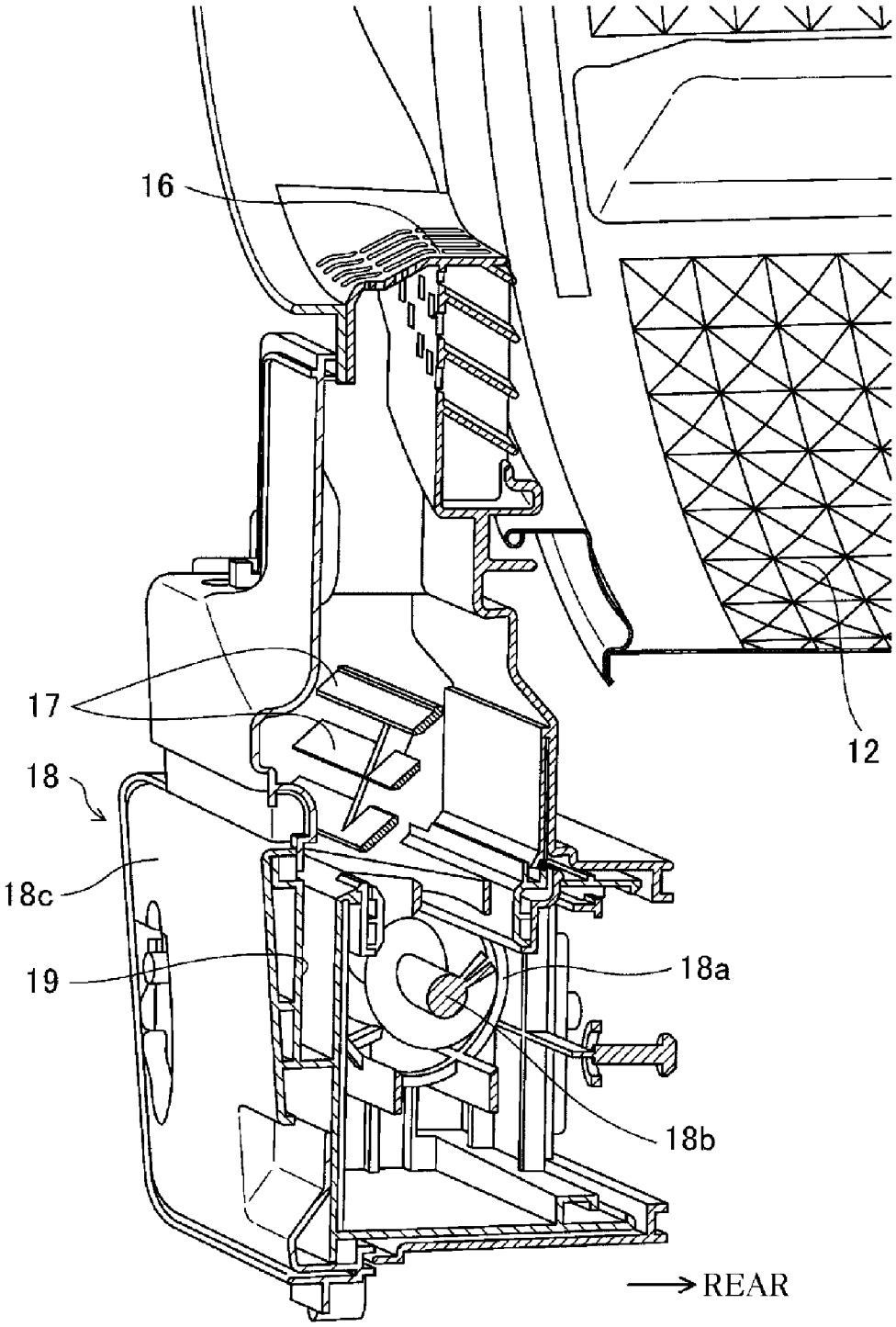
FIG. 4 is a partial cross-sectional perspective view illustrating a drum, the exhaust duct, the foreign-substance separating plates and the lint removing device constituting the clothes dryer according to the first embodiment of the present disclosure.
Figure 5:
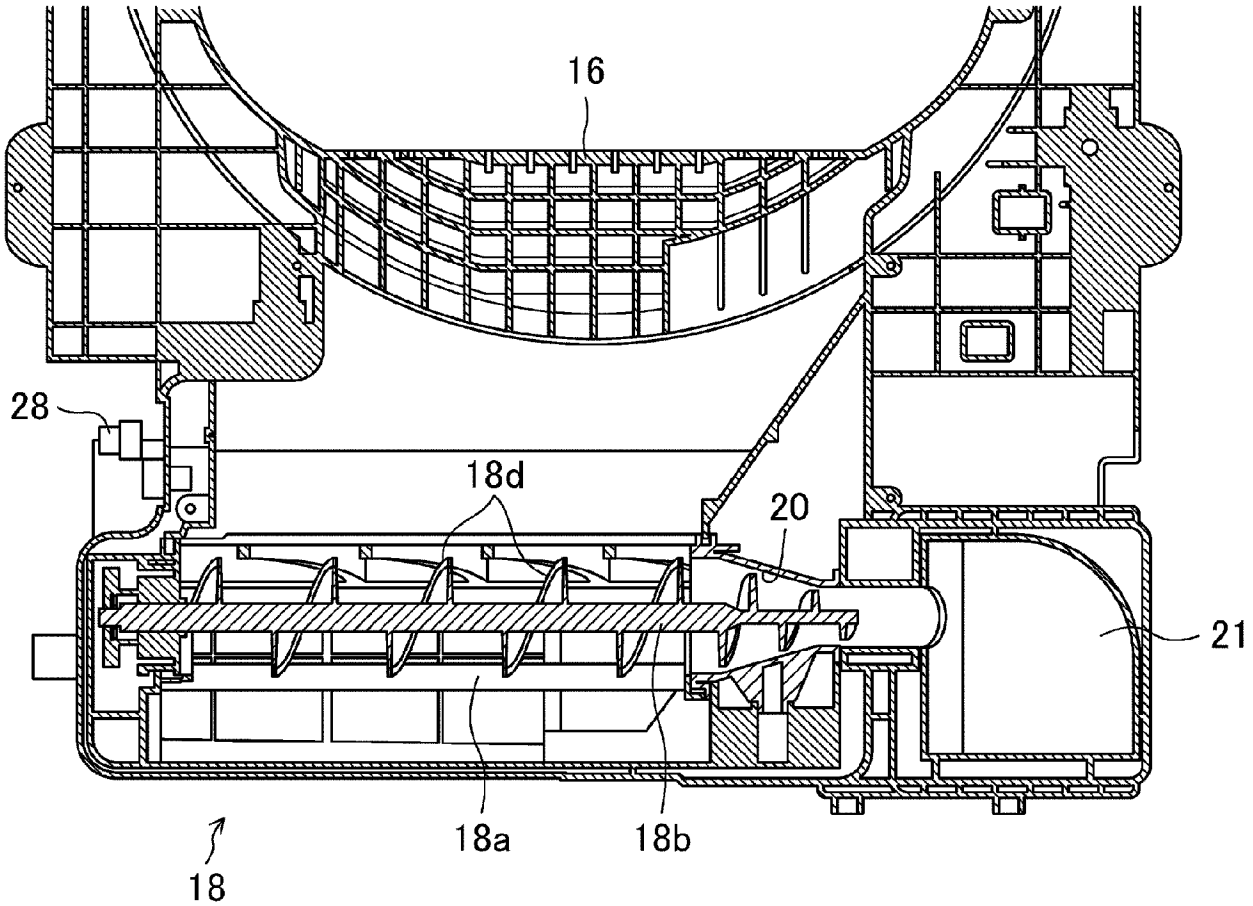
FIG. 5 is a partial cross-sectional view illustrating the exhaust duct, the lint removing device, a lint compression portion and a lint box constituting the clothes dryer according to the first embodiment of the present disclosure.
Figure 6:
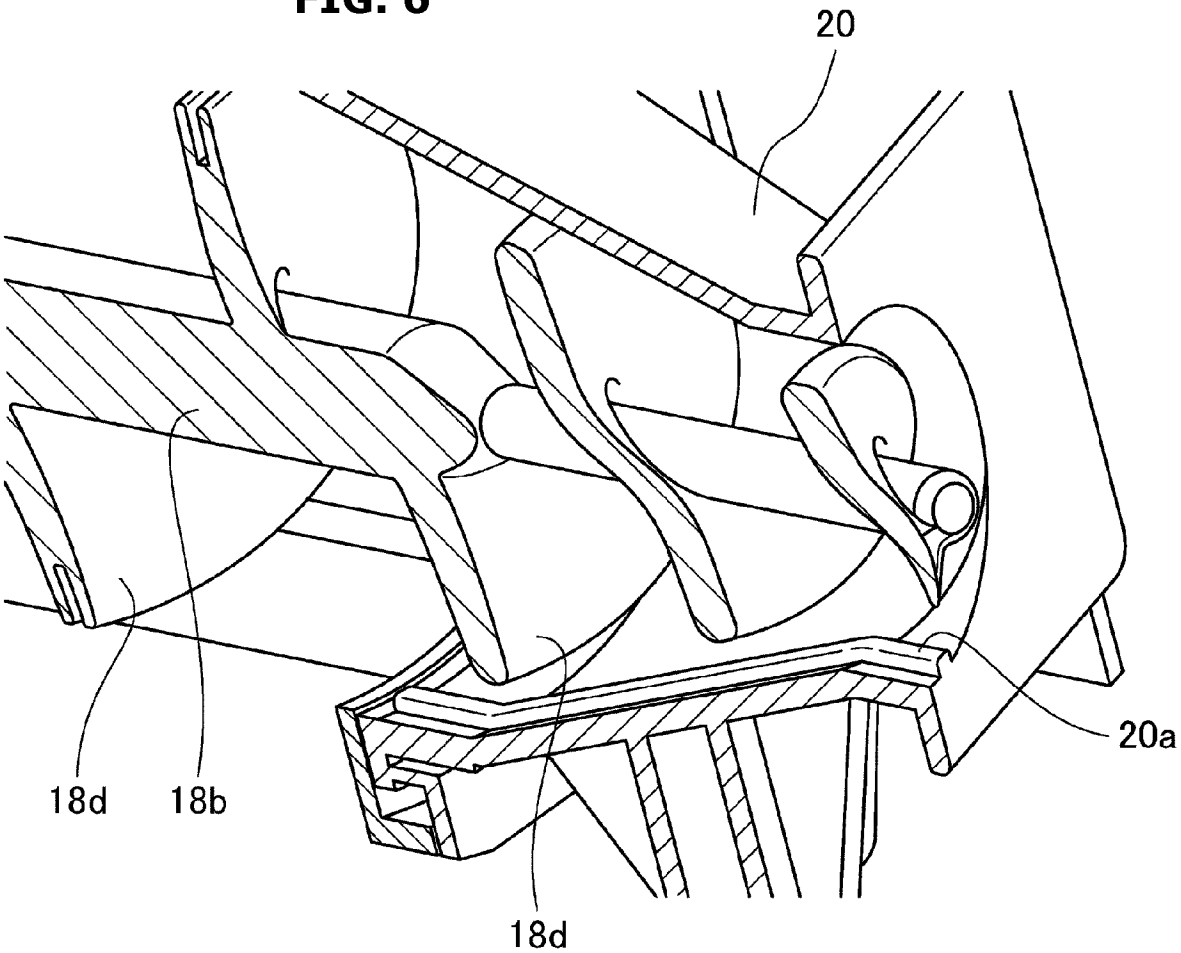
FIG. 6 is an enlarged partial perspective view illustrating a cross section of a lint conveying member and the lint compression portion constituting the clothes dryer according to the first embodiment of the present disclosure.
Figure 7:
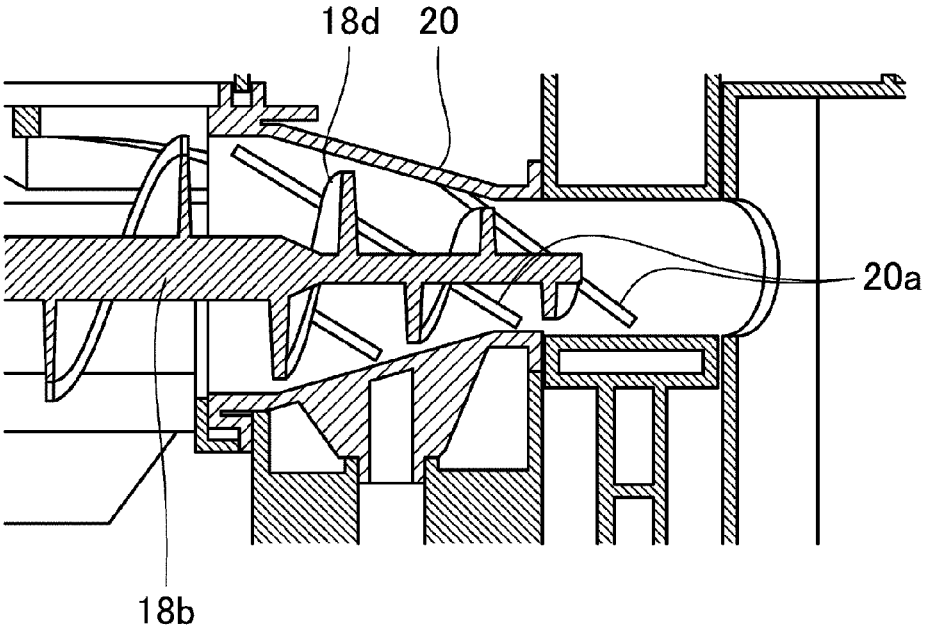
FIG. 7 is an enlarged partial cross-sectional view illustrating a cross section of a modified example of the lint conveying member and the lint compression portion constituting the clothes dryer according to the first embodiment of the present disclosure.
Figure 8:
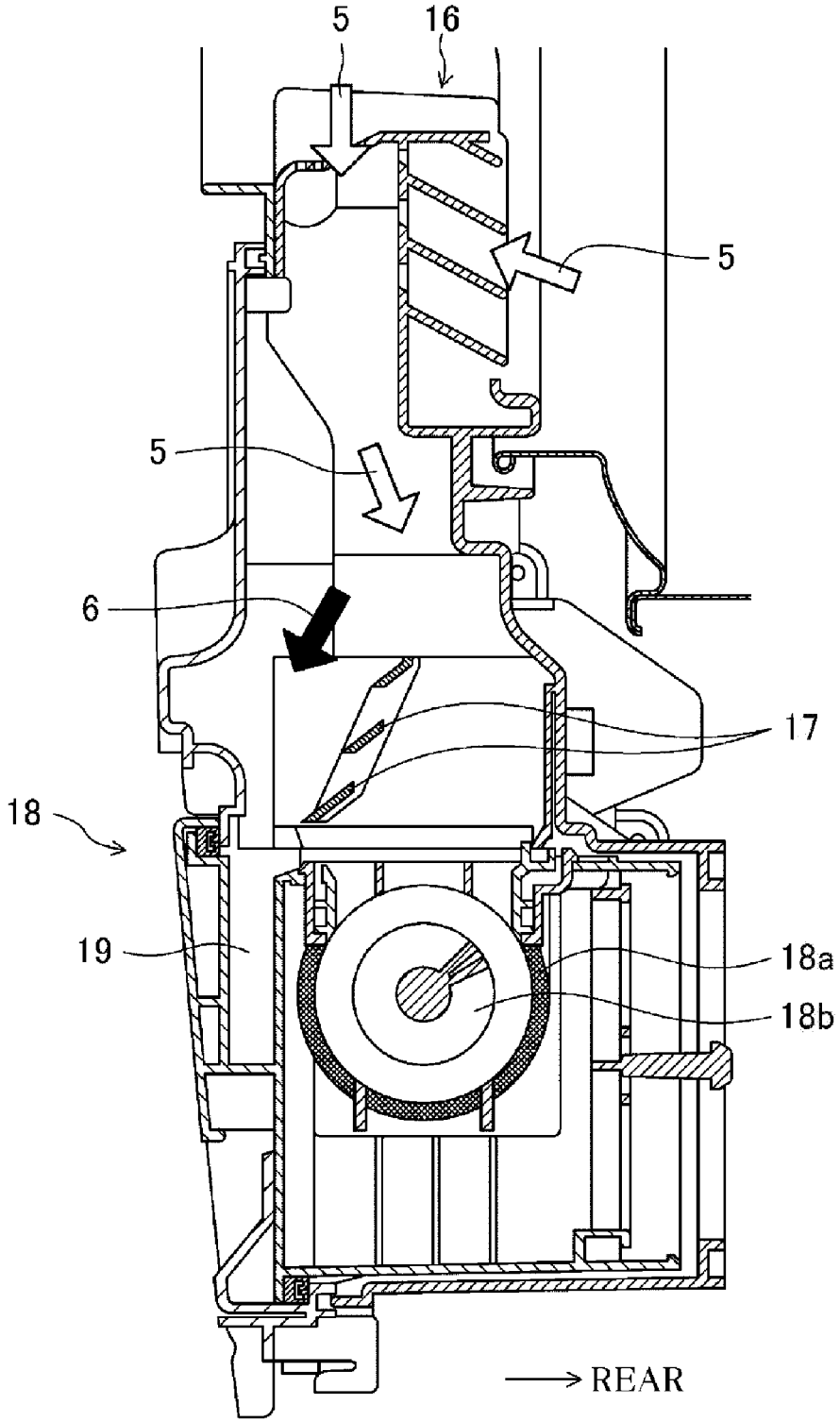
FIG. 8 is a partial cross-sectional view schematically illustrating respective flow paths of drying air and solid foreign substances from the exhaust duct to the lint removing device in the clothes dryer according to the first embodiment of the present disclosure.

The lint removing device 18 and foreign-substance separating plates 17 disposed on a upstream side thereof will be described below with reference to FIGS. 3 to 8. FIG. 3 is an enlarged view illustrating the exhaust duct 16, the foreign-substance separating plates 17 and a lint box 21, and FIG. 4 is an enlarged view illustrating the drum 12, the exhaust duct 16, the foreign-substance separating plates 17 and the lint removing device 18. In this case, the cross-sectional direction is a front-rear direction. FIG. 5 is an enlarged view illustrating the exhaust duct 16, the lint removing device 18, a lint compression portion 20 and the lint box 21, and in this case, the cross-sectional direction is a longitudinal direction. FIGS. 6 and 7 are enlarged views illustrating a lint conveying member 18*b* and the lint compression portion 20. FIG. 8 is an enlarged view schematically illustrating the respective flow paths of drying air and solid foreign substances from the exhaust duct 16 to the lint removing device 18, and in this case, the cross-sectional direction is the front-rear direction.

As illustrated in FIGS. 3 and 4, between the exhaust duct 16 and the lint removing device 18, specifically, on an upper portion of the lint removing device 18, there is provided a plurality of the foreign-substance separating plates 17 of a stepped shape spaced apart from each other to separate solid foreign substances such as buttons from drying air. The plurality of foreign-substance separating plates 17 of a stepped shape spaced apart from each other is an example of a foreign-substance separating member.

The lint removing device 18 is provided with a lint collecting filter 18*a* having an arc-shaped cross section in a direction perpendicular to a longitudinal direction thereof. As illustrated in FIGS. 4 and 5, on the inner surface of the filter 18*a*, there is provided the lint conveying member 18*b* including a screw (spiral) wing 18*d* for separating the collected lint. The lint conveying member 18*b* is driven by a conveying motor 28, and separates the lint collected in the filter 18*a* from the filter 18*a* and conveys the lint to the lint box 21 that receives and accumulates the lint. A member having a large coefficient of friction with the lint such as a rubber plate or a short-haired brush may be formed on a contact surface between the wing 18*d* of the lint conveying member 18*b* and the filter 18*a*. The lint box 21 is detachably attached to the main body of the clothes dryer 1, and the lint collected in the lint box 21 may be easily removed.

As illustrated in FIG. 5, the lint compression portion 20 of a conical shape having an opening diameter reduced toward the lint box 21 is provided between the filter 18*a* and the lint box 21. An end portion of the lint conveying member 18*b* on the side of the lint box 21 is inserted into the lint compression portion 20 and the diameter of the wing 18*d* of the lint conveying member 18*b* is also gradually reduced. A peripheral edge of the wing 18*d* on the lint conveying member 18*b* may be separated from or may be in contact with the inner surface of the lint compression portion 20. When a gap is formed between the wing 18*d* and the inner surface of the lint compression portion 20, the lint conveyed by the wing 18*d* hardly blocks the gap between the inner surface of the lint compression portion 20 and the wing 18*d*. On the other hand, when the wing 18*d* is in contact with the inner surface of the lint compression portion 20, the lint conveyed by the wing 18*d* may be restricted from remaining on the inner surface of the lint compression portion 20.

As illustrated in FIG. 6, at least one linear protrusion 20*a* extending toward the lint box 21 may be formed on the inner surface of the lint compression portion 20. The linear protrusion 20*a* formed on the inner surface of the lint compression portion 20 may impart a directivity directed to the lint box 21 to the lint conveyed by the wing 18*d*. Accordingly, the compressed lint may be surely conveyed to the lint box 21. As illustrated in FIG. 7, as a modified example, the protrusion 20*a* may be formed in a direction perpendicular to the angle of the wing 18*d*. With this configuration, the lint conveyed by the wing 18*d* of a spiral shape receives a force in a direction perpendicular to the wing 18*d*. Therefore, because the protrusion 20*a* is formed along a direction imparting a force to the lint, the lint may be conveyed more surely.

As illustrated in FIG. 4, a foreign-substance accommodating portion 19 is provided on the inner surface of a cover 18*c* covering a front surface of the lint removing device 18. In the present embodiment, each of the foreign-substance separating plates 17 is provided with an inclined surface inclined toward the foreign-substance accommodating portion 19. When solid foreign substances are introduced from the exhaust duct 16, the introduced solid foreign substances are guided to the foreign-substance accommodating portion 19 along the inclined surface of the foreign-substance separating plates 17.

As illustrated in FIG. 4, the filter 18*a* and the lint conveying member 18*b* may be freely detached from or attached to the cover 18*c* that is provided on the outside of the filter 18*a* and forms the foreign-substance accommodating portion 19. Also, the foreign substances accommodated in the foreign-substance accommodating portion 19 of the cover 18*c* may be easily removed.

According to the present embodiment, as illustrated in FIG. 8, for example, when solid foreign substances are introduced into an upper side of the lint removing device 18 together with the drying air 5 from an upper side of the exhaust duct 16, the solid foreign substances may be guided to the foreign-substance accommodating portion 19 disposed on the outside of the lint removing device 18 by the plurality of foreign-substance separating plates 17 of a stepped shape spaced apart from each other (a foreign substance path 6). Thus, damage of the filter 18*a* by the solid foreign substances may be prevented. Also, a gap is formed between the foreign-substance separating plates 17 to such an extent that the drying air 5 may sufficiently flow, in other words, the flow amount of the drying air 5 is not extremely reduced. That is, because the area for introducing the drying air 5 is secured in the foreign-substance separating plates 17, the lowering of the air flow rate is suppressed and the drying performance of the clothes dryer 1 is not lowered.

Figure 9:
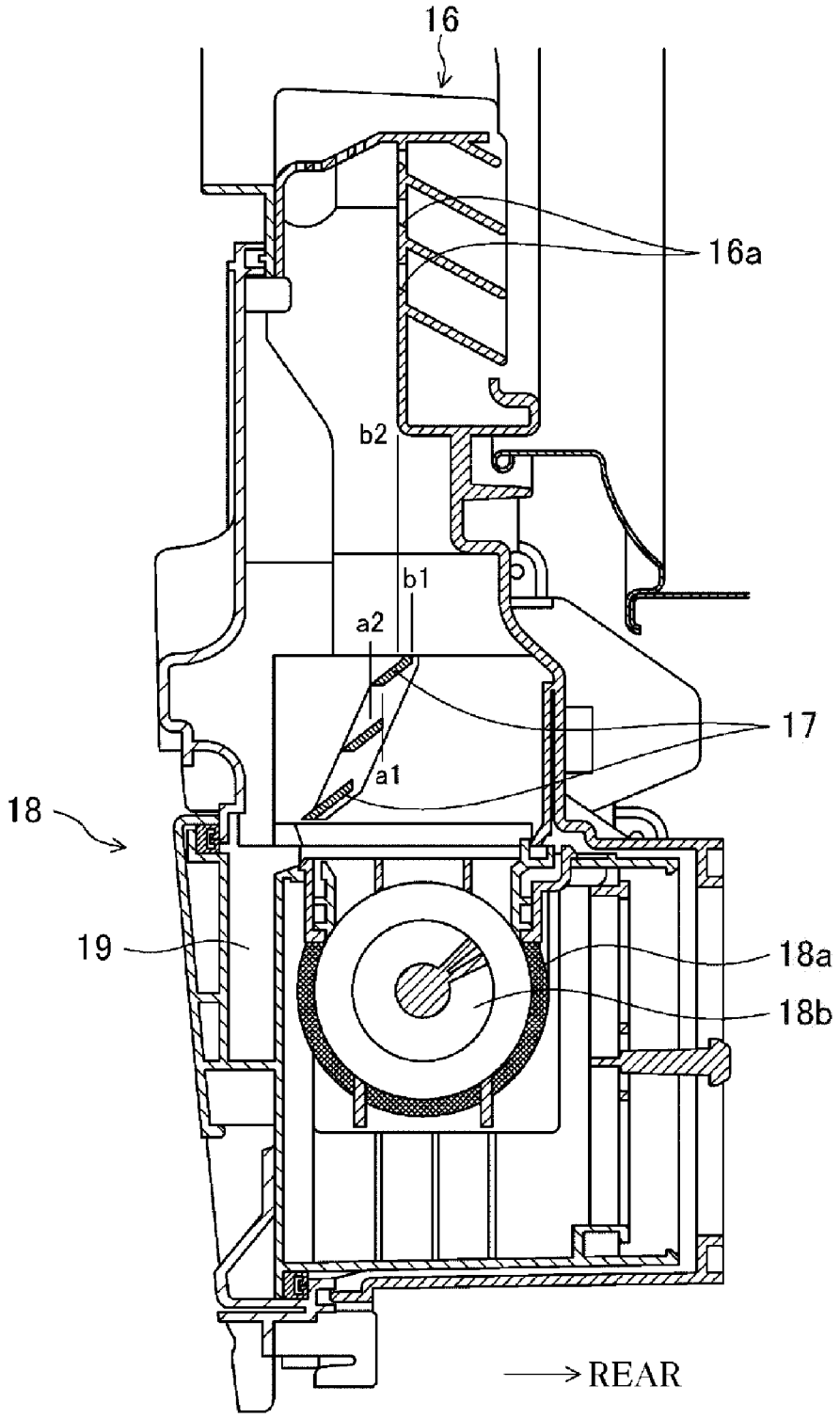
FIG. 9 is a partial cross-sectional view illustrating structural features of the foreign-substance separating plates constituting the clothes dryer according to the first embodiment of the present disclosure.

Structural features of the foreign-substance separating plates 17 according to the present embodiment will be described below with reference to FIG. 9. As illustrated in FIG. 9, the foreign-substance separating plates 17 are provided such that an upper end portion a1 of a lower foreign-substance separating plate is positioned further rearward than a lower end portion a2 of a higher foreign-substance separating plate. Therefore, even if solid foreign substances fall onto the foreign-substance separating plates 17, the solid foreign substances may be prevented from falling onto the lint removing device 18, that is, the filter 18*a*, from the gap between the foreign-substance separating plates 17 because the upper end portion a1 of the lower foreign-substance separating plate is positioned further rearward than the lower end portion a2 of the higher foreign-substance separating plate.

As illustrated in FIG. 9, a plurality of side inflow openings 16*a* is formed on a side of the exhaust duct 16. The uppermost end b1 of an upper inclined surface of the foreign-substance separating plate 17 is formed to be positioned further rearward than a front end side b2 of the side inflow openings 16*a*. Therefore, even if solid foreign substances enter from the side inflow openings 16*a* formed on the side of the exhaust duct 16, the solid foreign substances may be prevented from falling onto the lint removing device 18, that is, the filter 18*a* because the uppermost end b1 of the upper inclined surface of the foreign-substance separating plate 17 is positioned further rearward than the front end side b2 of the side inflow openings 16*a*.

(Modified Examples of the Foreign-Substance Separating Member)

In the above-described first embodiment, the foreign-substance separating member is constituted by a plurality of plate members of a stepped shape spaced apart from each other.

However, the foreign-substance separating member according to the present disclosure is not limited to a plate-shaped member. For example, the foreign-substance separating member may be formed in a raft shape or a blind shape in which a plurality of columnar members are spaced apart from each other on one surface instead of the plate-shaped member.

Further, even when the foreign-substance separating member is formed in a plate shape, a plurality of holes may be formed in each of the foreign-substance separating plates 17.

Even in any modified example, the opening area of the foreign-substance separating member may be enlarged. However, the gap and opening formed on the upper surface of each of the foreign-substance separating members need to be dimensioned not to pass an assumed solid foreign substance.

Second Embodiment

Hereinafter a second embodiment of the present disclosure will be described with reference to the drawings.

Figure 10:
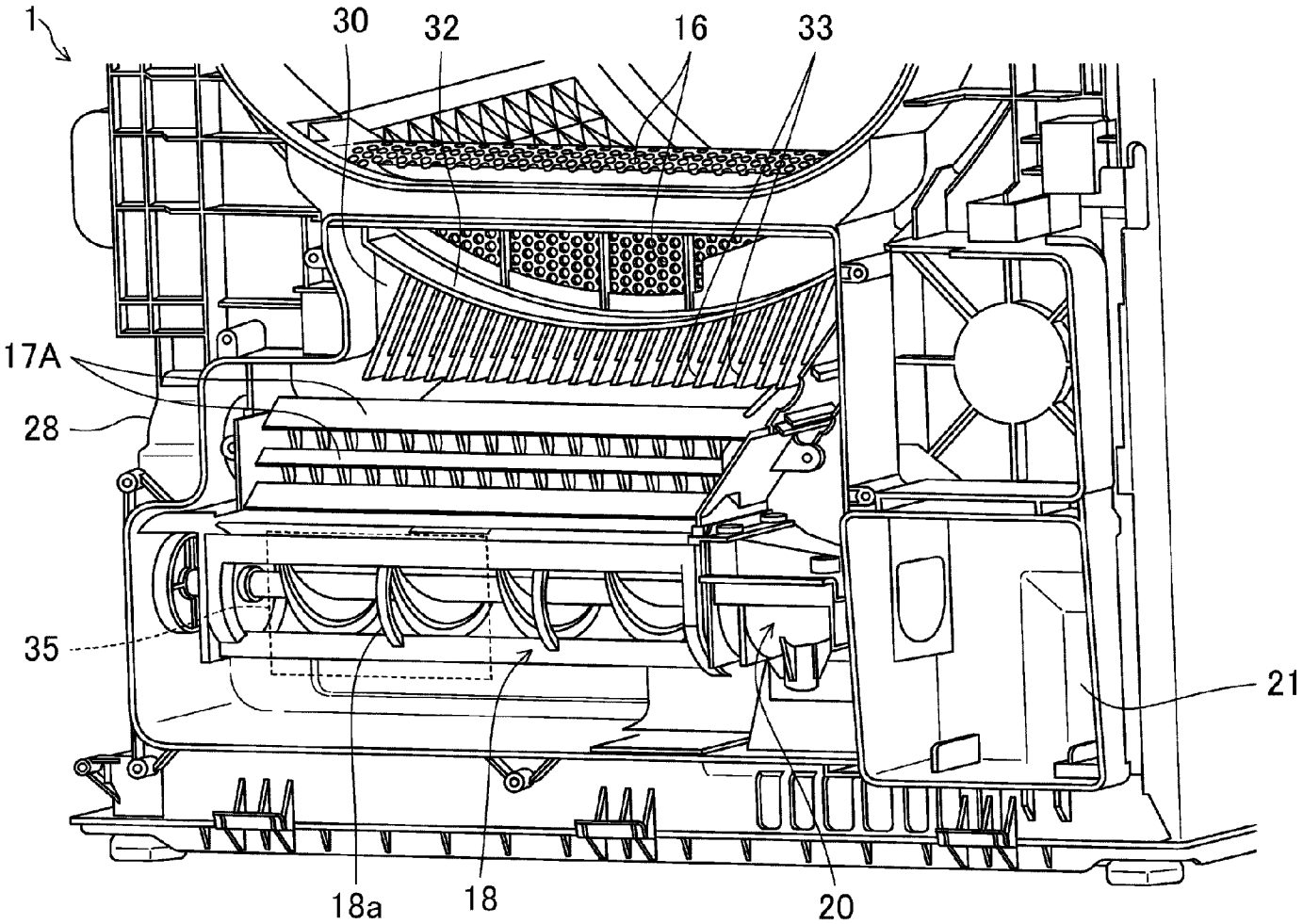
FIG. 10 is a partial perspective view illustrating an exhaust duct, foreign-substance separating plates and a lint removing device constituting a clothes dryer according to a second embodiment of the present disclosure.

FIG. 10 illustrates a configuration of a clothes dryer according to the second embodiment. FIG. 10 is a partial perspective view corresponding to FIG. 3 illustrating the clothes dryer 1 according to the first embodiment. In the second embodiment, the same components as those described in the first embodiment are denoted by the same reference numerals, and a description thereof will be omitted.

As illustrated in FIG. 10, as a first difference, the clothes dryer 1 according to the present embodiment differs from the clothes dryer 1 according to the first embodiment in the configuration of foreign-substance separating plates 17A.

As a second difference, an arc-shaped rib 32, which is formed between a partition 30 positioned below a vertical plane of the exhaust duct 16 as the rear of the foreign-substance separating plates 17A and the vertical plane of the exhaust duct 16, protrudes in an awning shape on the foreign-substance separating plates 17A side (front side), that is, on an upper side of the lint removing device 18. In addition, a wind path of drying wind (drying air) having a sufficient capacity not to increase the pressure loss is formed on the rear of the foreign-substance separating plates 17A as a lower side of the arc-shaped rib 32.

As a third difference, the partition 30 is provided with a plurality of foreign-substance removing plates 33.

On the other hand, an air inlet port 35 communicating with the air supply port 26 (refer to FIG. 1) is formed on a rear side of a left side portion of the lint removing device 18.

Figure 11:
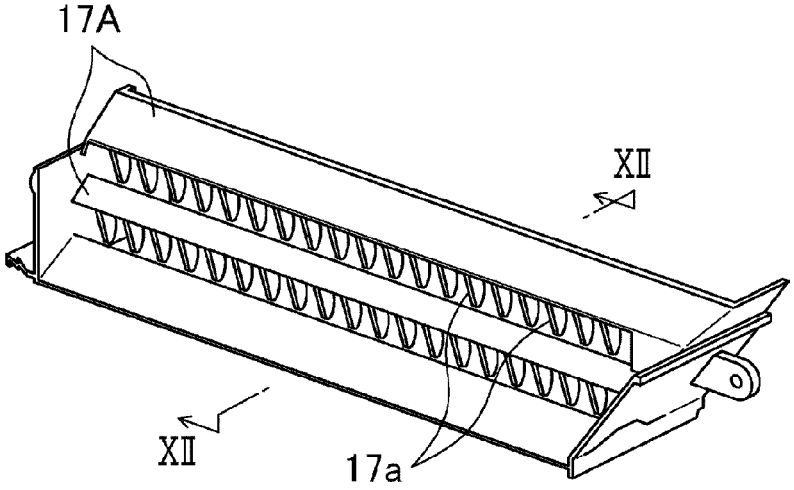
FIG. 11 is a perspective view illustrating the foreign-substance separating plates constituting the clothes dryer according to the second embodiment of the present disclosure.

FIG. 11 is a perspective view of the foreign-substance separating plates 17A according to the present embodiment. As illustrated in FIG. 11, the foreign-substance separating plates 17A include a plurality of protrusions 17*a* extending from an upper separating plate toward a lower separating plate between the separating plates vertically adjacent to each other. Specifically, the protrusions 17*a* are formed to extend from a lower surface of a front portion of the upper foreign-substance separating plate 17A to a rear portion of an upper surface of the lower foreign-substance separating plate 17A. The entry of solid foreign substances into the lint removing device 18 from the gap between the foreign-substance separating plates 17A may be restricted by the protrusions 17*a*. In this case, in order to reduce the air resistance, it is preferable that the thickness of the protrusions 17*a* is small.

Figure 12:
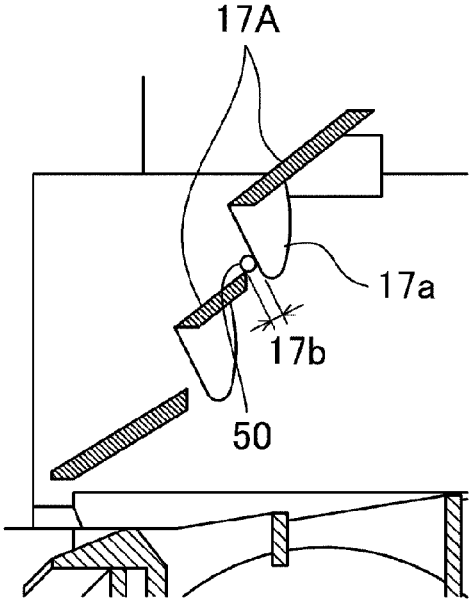
FIG. 12 is a cross-sectional view taken along a line XII-XII in FIG. 11.

FIG. 12 illustrates a sectional configuration of the foreign-substance separating plates 17A and the protrusions 17*a* in the front-rear direction. As illustrated in FIG. 12, the protrusion 17*a* may be formed such that the width in the front-rear direction gradually decreases from a base portion (upper portion) toward a front end portion (lower end portion), for example. With this configuration, the lint may be restrained from adhering to the protrusion 17*a*, and the pressure loss of the drying wind may be reduced.

A gap 17*b* for restraining the lint from being caught may be formed between the front end portion of the protrusion 17*a* and a rear end portion of the lower foreign-substance separating plate 17A facing the protrusion 17*a*. The gap 17*b* may be of a size such that a needle-shaped foreign substance 50 does not enter. The needle-shaped foreign substance 50 may be, for example, a wire for underwear made of metal or resin, a hairpin made of metal or resin, or a wooden toothpick. When the needle-shaped foreign substance 50 is light as a toothpick, it is assumed that the foreign substance 50 enters the lint removing device 18 from the gap between the foreign-substance separating plates 17A by the turbulence of the drying wind from the foreign-substance path (arrow 6) illustrated in FIG. 8. Therefore, if the size of the gap 17*b* is set to such a degree that the needle-shaped foreign substance 50 does not enter, the entry of the needle-shaped foreign substance 50 may be restrained, and the lint is less likely to be caught by the protrusion 17*a* by the gap 17*b* formed between the lower portion of the protrusion 17*a* and the foreign-substance separating plate 17A at the lower end thereof. As a result, an increase in the pressure loss of the drying wind caused by the clogging of the lint may be prevented.

Figure 13:
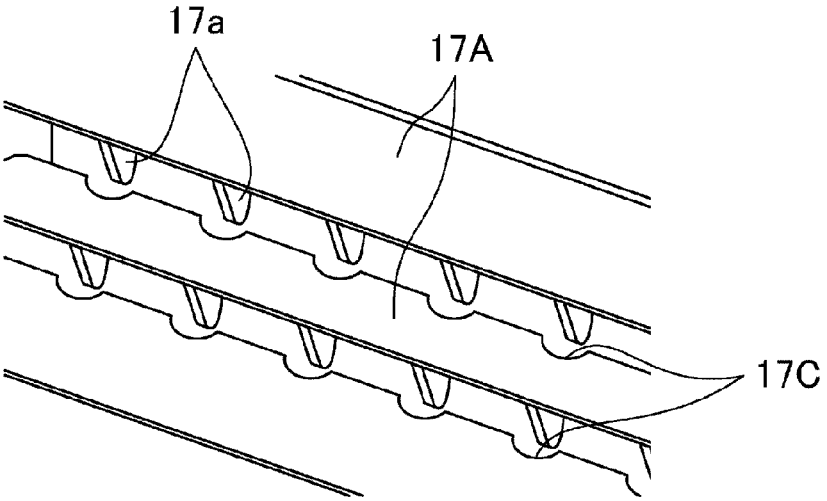
FIG. 13 is a partial perspective view illustrating a modified example of the foreign-substance separating plates according to the second embodiment of the present disclosure.

FIG. 13 illustrates a modified example of the foreign-substance separating plates 17A illustrated in FIGS. 11 and 12. As illustrated in FIG. 13, as a modified example, a notch 17C may be formed, for example, in a region opposite to the protrusion 17*a* of the lower foreign-substance separating plate 17A. With this configuration, deposition of the lint may be further restricted while restricting the entry of the solid foreign substance.

Figure 14:
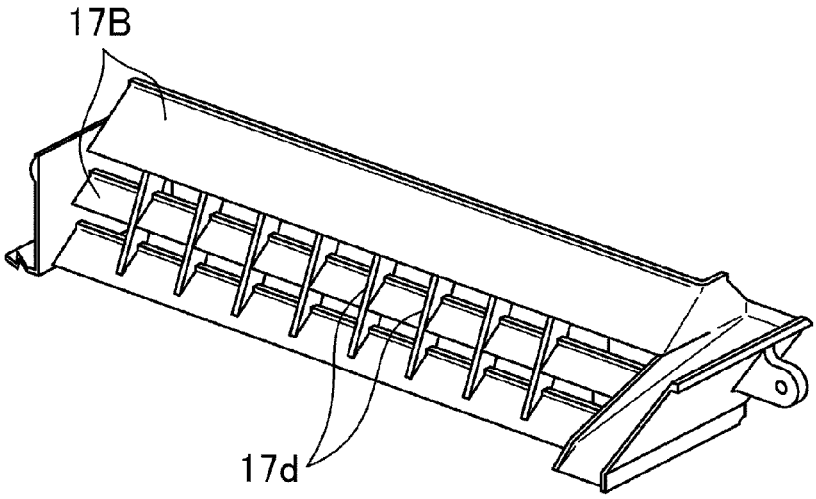
FIG. 14 is a partial perspective view illustrating another modified example of the foreign-substance separating plates according to the second embodiment of the present disclosure.

FIG. 14 illustrates foreign-substance separating plates 17B which are another modified example of the foreign-substance separating plates 17. As illustrated in FIG. 14, the foreign-substance separating plates 17B according to the present modified example are provided with a plurality of ribs 17*d* instead of the protrusions 17*a*, for connecting the foreign-substance separating plates 17B adjacent to each other in the vertical direction. Even in this case, the ribs 17*d* may restrict the entry of the solid foreign substances into the lint removing device 18 from the gap between the foreign-substance separating plates 17B. Also in this case, it is preferable that the thickness of each rib 17*d* is small in order to reduce the air resistance. The plurality of foreign-substance separating plates 17A and 17B having a stepped shape spaced apart from each other and including the protrusions 17*a* or the connected ribs 17*d* are examples of the foreign-substance separating member.

Although a plurality of ribs for connecting the foreign-substance separating plates 17 adjacent to each other in the vertical direction are formed in the foreign-substance separating plates 17 according to the first embodiment illustrated in FIGS. 3 and 4, the number of the arranged ribs is as small as two to three, and thus the ribs have small effects on restricting the entry of solid foreign substances and mainly serve as a reinforcing member for the foreign-substance separating plates 17.

Figure 15:
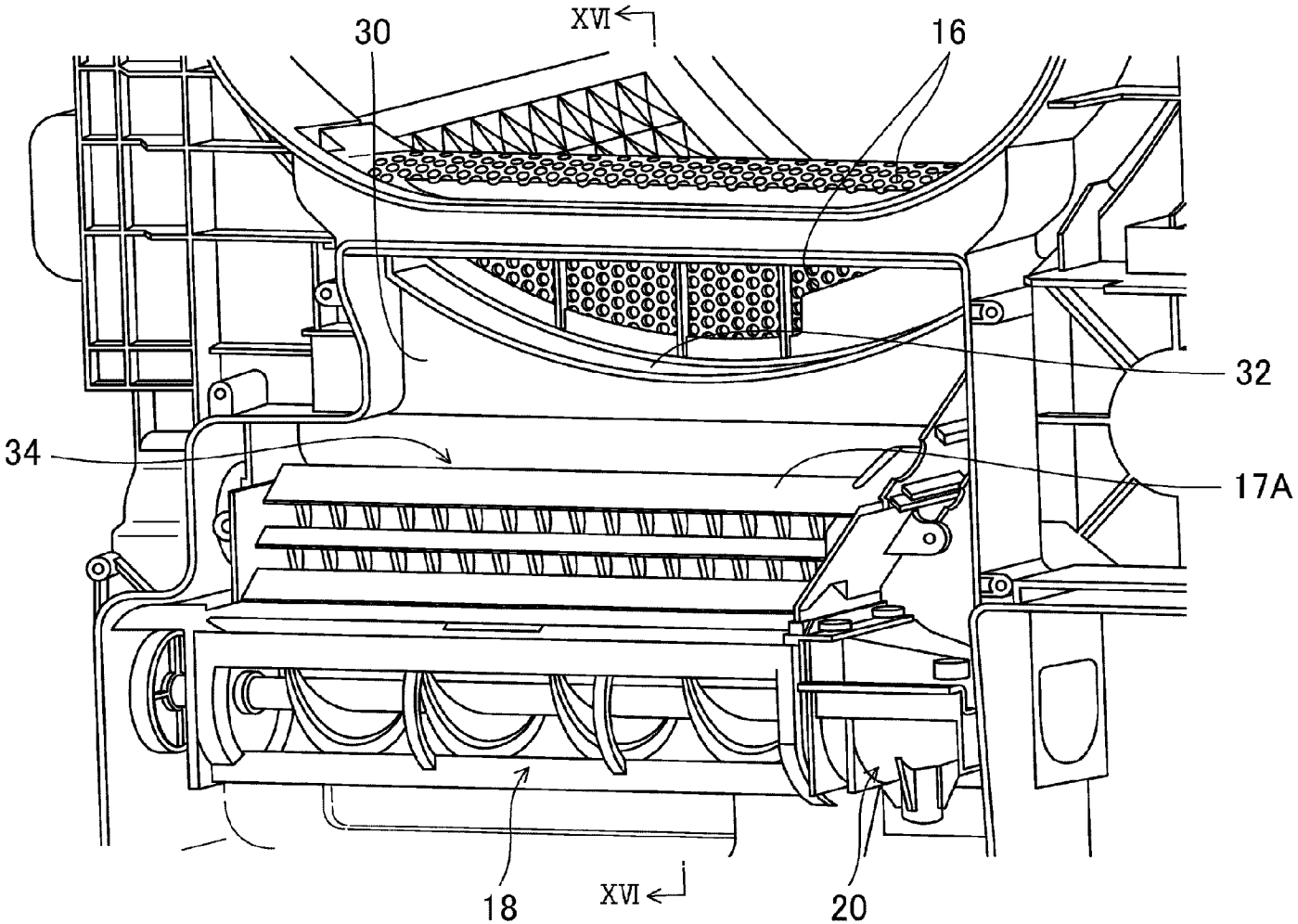
FIG. 15 is a partial perspective view illustrating the structure of main components including the foreign-substance separating plates and the lint removing device according to the second embodiment of the present disclosure.
Figure 16:
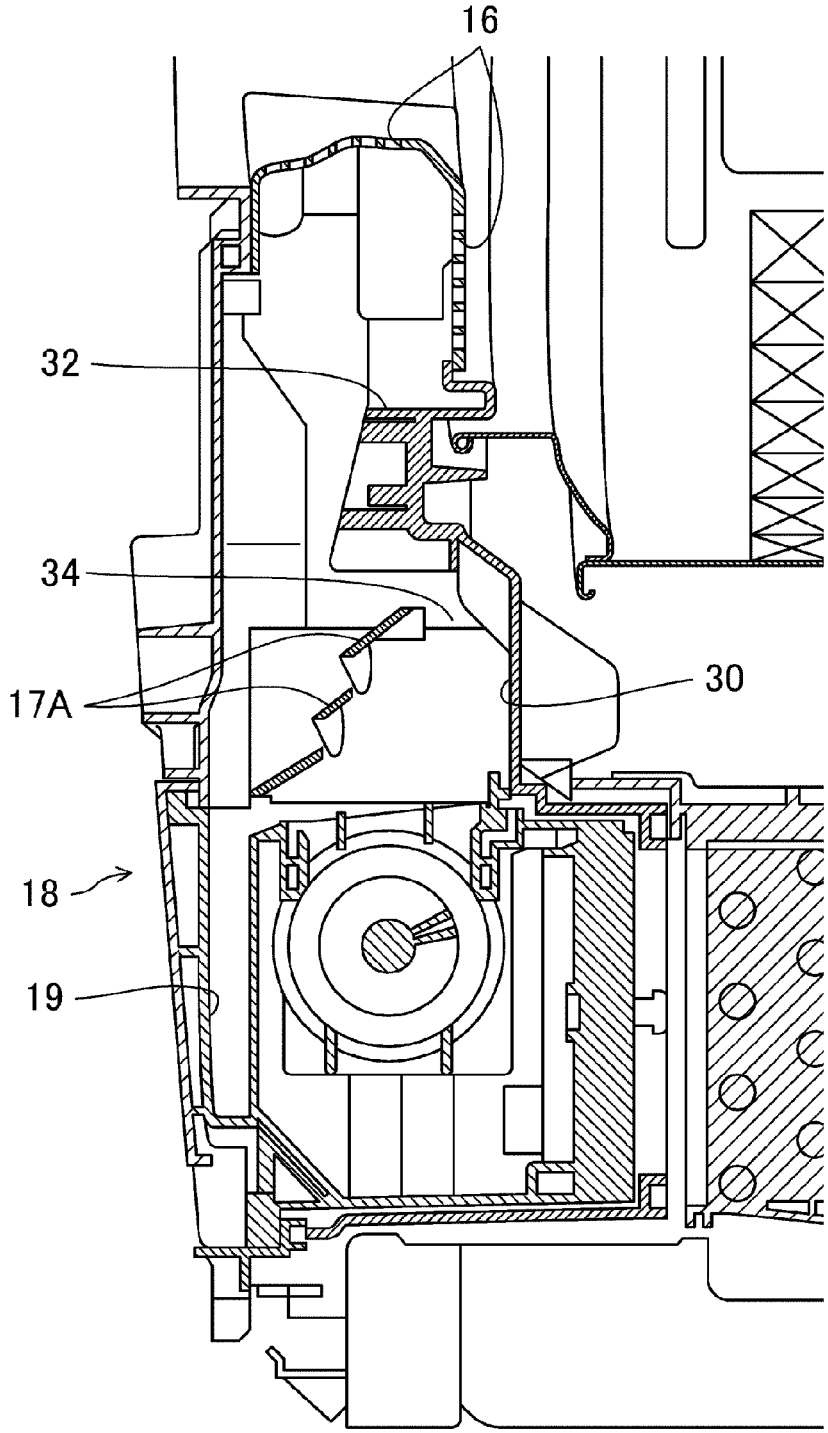
FIG. 16 is a cross-sectional view taken along a line XVI-XVI in FIG. 15.

FIG. 15 illustrates the structure of main components including the foreign-substance separating plates 17A and the lint removing device 18 according to the present embodiment, and FIG. 16 illustrates the cross-sectional structure taken along a line XVI-XVI in FIG. 15. As illustrated in FIGS. 15 and 16, the partition 30 is disposed on the rear of the foreign-substance separating plates 17A below the vertical plane of the exhaust duct 16. The arc-shaped rib 32 protruding to the foreign-substance separating plates 17A side, that is, the upper side of the lint removing device 18 is formed between the partition 30 and the vertical plane of the exhaust duct 16. The entry of the solid foreign substances into lint removing device 18 through the exhaust duct 16 may be prevented by the arc-shaped rib 32 protruding to the upper side of the lint removing device 18.

In this case, as illustrated in FIG. 16, a front end portion of the arc-shaped rib 32 may be disposed to be positioned further forward than a rear end portion of the uppermost foreign-substance separating plate among the foreign-substance separating plates 17A. In addition, it is preferable that the gap between the rear end portion of the uppermost foreign-substance separating plate and the partition 30 is set to be formed such that the solid foreign substances passing through the exhaust duct 16 do not pass.

In addition, because the partition 30 is disposed to be biased toward the rear side and the plurality of foreign-substance separating plates 17A is inclined forward toward the lower side, a wind path 34 of drying air positioned on the lower side (downstream side) from the gap between the rear end portion of the uppermost foreign-substance separating plate and the partition 30 is formed to extend toward the lint removing device 18. With this configuration, it becomes difficult for the solid foreign substances to enter the lint removing device 18, and the pressure loss in the wind path 34 may be reduced.

Figure 17:
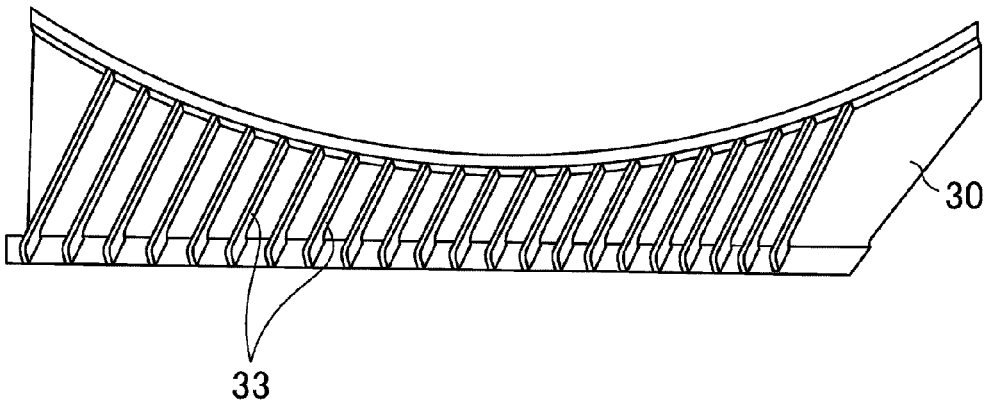
FIG. 17 is a perspective view illustrating a foreign-substance removing plate constituting the clothes dryer according to the second embodiment of the present disclosure.

FIG. 17 illustrates a detailed plan configuration of the foreign-substance removing plate 33 illustrated in FIG. 10. As illustrated in FIG. 17, a plurality of foreign-substance removing plates 33 according to the present embodiment is arranged in parallel above the surface of the foreign-substance separating plate 17A side (front side) at the partition 30 below the exhaust duct 16, for example, at the partition 30 below the arc-shaped rib 32 described above. The plurality of foreign-substance removing plates 33 each is provided in the form of a plate having a large length-to-width ratio and arranged in an inclined manner such that the extending direction thereof is directed toward the air inlet port 35 (refer to FIG. 10). The foreign-substance removing plates 33 each may have a width of about 1 mm to about 3 mm, a height of about 10 mm to 35 mm, and may be spaced from each other by about 5 mm to 10 mm, for example.

As such, by disposing the plurality of foreign-substance removing plates 33 on the partition 30 below the exhaust duct 16, the solid foreign substances which are flowed by the drying wind and enter the lint removing device 18 may be discharged toward the foreign-substance separating plates 17A side.

In the present embodiment, the foreign-substance removing plates 33 are provided and arranged in such a manner as not to block the drying wind. In addition, by reducing the plate thickness of the foreign-substance removing plates 33, the pressure loss of the drying wind is reduced.

Figure 18:
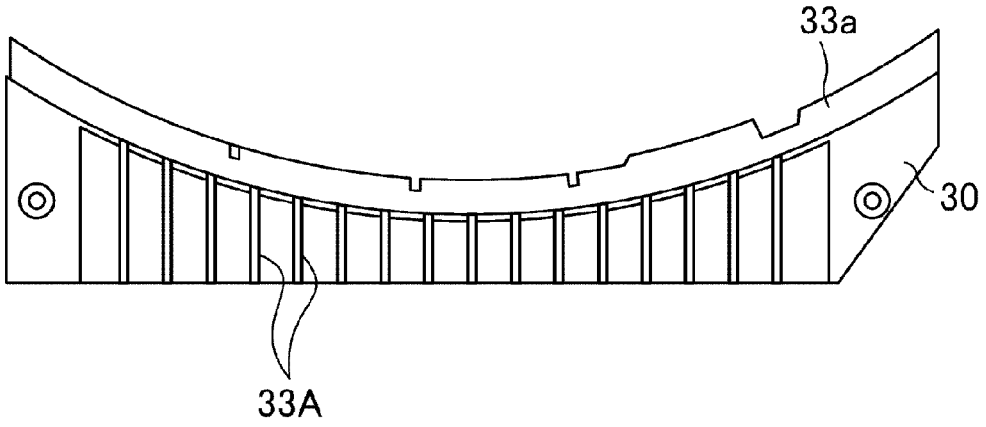
FIG. 18 is a perspective view illustrating a modified example of the foreign-substance removing plate constituting the clothes dryer according to the second embodiment of the present disclosure.

FIG. 18 illustrates the structure of the front surface of a modified example of the foreign-substance removing plate 33 according to the present embodiment. As illustrated in FIG. 18, foreign-substance removing plates 33A according to the present modified example are arranged in parallel such that the extending directions of the respective long axes are directed to the vertical direction.

In addition, in this modified example, an inclined surface 33*a* that thins the exhaust duct 16 side and thickens the foreign-substance removing plate 33A side (the upper portion is thinner and the lower portion is thicker) is formed at a peripheral edge of the partition 30 on the side of the exhaust duct 16. A horizontal cross section is not formed at the foreign-substance removing plate 33A on the exhaust duct 16 side by the inclined surface 33*a*. As a result, the solid foreign substances and the lint may be prevented from being caught on the peripheral edge of the partition 30 on the exhaust duct 16 side. In the case of this modified example, the foreign-substance removing plates 33A are arranged in parallel such that the long axes thereof are aligned in the vertical direction, and the manufacture thereof is relatively easy.

As illustrated in FIG. 15, if the above-described arc-shaped rib 32 is formed, the foreign-substance removing plates 33 and 33A according to the present embodiment are not necessarily required. That is, only at least one of the arc-shaped rib 32 and the foreign-substance removing plates 33 and 33A may be formed.

The second embodiment is also applied to the clothes dryer 1, but the present disclosure is not limited thereto and is applicable to a washing and drying machine. In addition, although a belt is used for rotating the drum 12, a DD motor system in which a drum rotation shaft is directly rotated by a motor rotation shaft may be used. Further, although the heat exchanger 22 is used to generate and dehumidify drying air, a heater system including a heater for generating hot air provided in the main body of the clothes dryer 1 may be used.

The invention claimed is:

1. A clothes dryer comprising:

a drum to stir clothes accommodated therein;

an exhaust duct configured to discharge air from inside the drum;

a lint removing device including a filter to remove lint in air discharged to the exhaust duct; and a plurality of foreign-substance separating plates disposed between the exhaust duct and the lint removing device to separate solid foreign substances in the air discharged from the exhaust duct, wherein the plurality of foreign-substance separating plates is configured to guide the separated solid foreign substances to a foreign-substance accommodating portion.

2. The clothes dryer according to claim 1, wherein the plurality of foreign-substance separating plates includes an inclined surface inclined toward an outside of the lint removing device.

3. The clothes dryer according to claim 2, wherein the plurality of foreign-substance separating plates is disposed in a stepped shape with a gap between foreign-substance separating plates among the plurality of foreign-substance separating plates.

4. The clothes dryer according to claim 3, wherein between two of the foreign-substance separating plates adjacent to each other among the plurality of foreign-substance separating plates, an upper end portion of a lower foreign-substance separating plate is positioned further rearward than a lower end portion of an upper foreign-substance separating plate.

5. The clothes dryer according to claim 2, wherein:

the exhaust duct includes a side inflow opening formed in a side portion thereof, and an uppermost end portion of the inclined surface of the plurality of foreign-substance separating plates is positioned further rearward than a front end portion of the side inflow opening.

6. The clothes dryer according to claim 2, further comprising wherein the foreign-substance accommodating portion is disposed below the plurality of foreign-substance separating plates and outside the lint removing device, wherein the inclined surface of the plurality of foreign-substance separating plates is inclined toward the foreign-substance accommodating portion.

7. The clothes dryer according to claim 3, wherein the plurality of foreign-substance separating plates includes a rib to connect two of the foreign-substance separating plates adjacent to each other.

8. The clothes dryer according to claim 3, wherein the plurality of foreign-substance separating plates includes a protrusion protruding from a lower surface of an upper foreign-substance separating plate toward an upper surface of a lower foreign-substance separating plate of two of the foreign-substance separating plates adjacent to each other, and the gap is formed between the protrusion of the upper foreign-substance separating plate and the lower foreign-substance separating plate.

9. The clothes dryer according to claim 8, wherein the lower foreign-substance separating plate includes a notch formed on a region facing the protrusion.

10. The clothes dryer according to claim 1, further comprising an air inlet port formed in a rear of the lint removing device and connected to an air supply port inflowing inlet air into the drum, wherein a wind path to flow air is formed between the plurality of foreign-substance separating plates and a partition in the rear of the plurality of foreign-substance separating plates.

11. The clothes dryer according to claim 10, further comprising an arc-shaped rib protruding in an awning shape from the partition below the exhaust duct and above the lint removing device.

12. The clothes dryer according to claim 10, further comprising a plurality of foreign-substance removing plates arranged in parallel between the exhaust duct and the plurality of foreign-substance separating plates such that extending directions thereof are directed to a vertical direction or the air inlet port.

13. The clothes dryer according to claim 1, wherein the filter extends in a direction intersecting a rotation shaft of the drum and has an arc-shaped cross section in a direction perpendicular to a longitudinal direction thereof, and the lint removing device includes a lint conveying member provided inside the filter and including a rotation shaft parallel to the longitudinal direction of the filter.

14. The clothes dryer according to claim 13, wherein the lint conveying member includes a spiral wing in contact with an inner surface of the filter.

15. The clothes dryer according to claim 14, further comprising:

a lint box to accumulate lint separated and conveyed from the inner surface of the filter by a rotation of the spiral wing of the lint conveying member; and a conical lint compression portion disposed between the filter and the lint box and decreasing in diameter toward the lint box.

16. The clothes dryer according to claim 15, wherein an end of the lint conveying member in the lint box is inserted into the conical lint compression portion, and the spiral wing of the lint conveying member is formed such that the diameter thereof decreases with a decrease in the diameter of the conical lint compression portion and a peripheral edge thereof is spaced apart from the inner surface of the conical lint compression portion.

17. The clothes dryer according to claim 15, wherein an end of the lint conveying member in the lint box is inserted into the conical lint compression portion, and the spiral wing of the lint conveying member is formed such that a peripheral edge thereof contacts the inner surface of the conical lint compression portion.

18. The clothes dryer according to claim 15, wherein the conical lint compression portion includes at least one protrusion extending to the lint box on the inner surface thereof.

19. The clothes dryer according to claim 18, wherein the protrusion is formed in a direction perpendicular to an angle of the spiral wing of the lint conveying member.

20. The clothes dryer according to claim 1, wherein the lint removing device includes:

a filter extending in a direction intersecting a rotation shaft of the drum and having an arc-shaped cross section in a direction perpendicular to a longitudinal direction thereof;

a lint conveying member provided inside the filter, and including a rotation shaft parallel to the longitudinal direction of the filter and a spiral wing formed such that a peripheral edge thereof is in contact with an inner surface of the filter;

a lint box to accumulate lint separated and conveyed from the inner surface of the filter by a rotation of the spiral wing of the lint conveying member; and a lint compression portion disposed between the filter and the lint box and decreasing in diameter toward the lint box.

* * * * *